United States Patent [19]

Moore III

[11] Patent Number: 4,869,183

[45] Date of Patent: Sep. 26, 1989

[54] DEVICE FOR POSITIONING AN EMBROIDERY HOOP

[76] Inventor: Edgar F. Moore III, 4447 Old Randleman Rd., Greensboro, N.C. 27406

[21] Appl. No.: 123,340

[22] Filed: Nov. 20, 1987

[51] Int. Cl.[4] ..... D05C 9/04

[52] U.S. Cl. ..... 112/103; 33/573; 112/65; 112/121.12

[58] Field of Search ..... 29/448, 559; 112/103, 112/121.12, 121.14, 262.3, 266.1, 65; 160/380; 269/99, 100; 33/568, 571, 573; 38/102.2

[56] References Cited

U.S. PATENT DOCUMENTS

| | | | |
|---|---|---|---|
| 1,426,263 | 8/1922 | Dox | 33/571 |
| 1,506,641 | 8/1924 | Hanke et al. | 33/568 X |
| 2,122,221 | 6/1938 | Valiquette | 33/573 |
| 2,908,303 | 10/1959 | Schmidt Jr. | 269/100 |
| 2,989,015 | 6/1961 | Taketomi | 112/103 |
| 3,750,186 | 7/1973 | Sakamoto | 112/121.12 X |
| 4,195,581 | 4/1980 | Ohara | 112/103 |
| 4,388,883 | 6/1983 | Hirota et al. | 112/121.12 |
| 4,445,678 | 5/1984 | George | 269/99 X |

FOREIGN PATENT DOCUMENTS

| | | | |
|---|---|---|---|
| 14318 | 6/1914 | United Kingdom | 112/79 |
| 799161 | 8/1958 | United Kingdom | 38/102.2 |

*Primary Examiner*—Mark Rosenbaum
*Assistant Examiner*—Andrew E. Rawlins

[57] ABSTRACT

A device and method for positioning an outer embroidery hoop on a framing table includes a hoop attachment having a hoop receiver which is adjustably mounted on a framing table. The hoop receiver can be released and slid along the upper table top surface and rotated as desired for infinite positioning. A side hoop attachment is also provided for jacket hoops and the framing table top can be removed and replaced with smaller or larger table tops as needed.

7 Claims, 8 Drawing Sheets

DEVICE FOR POSITIONING AN EMBROIDERY HOOP

BACKGROUND OF THE INVENTION

1. Field Of The Invention

The invention herein presented provides a device and method for selectively positioning an embroidery hoop on a framing table for framing cloth prior to embroidering thereon.

2. Description Of The Prior Art And Objectives Of The Invention

Various types of jigs and systems have been employed in the past to effectively position an outer embroidery hoop whereby a shirt or other garmet can be framed for embroidering. If shirt or other material is not properly tensioned between the outer and inner embroidery hoops, the subsequent sewing operation will incorrectly embroider the garment thereby causing a time loss for the operator and resulting in the garment probably being discarded at an additional expense and loss.

Various types of framing tables have been employed in the past whereby the outer embroidery hoop is correctly positioned on the table prior to garment coverage and subsequent to inner hoop contact and framing. Such apparatus and methods have worked to some degree, however, oftentimes production runs of a particular garment may be extremely short and the lack of flexibility and adjustability of current framing methods and apparatus have caused inefficient and costly framing procedures to result.

With the knowledge and disadvantages known of conventional embroidery framing systems and methods, the present invention was conceived and one of its objectives is to provide a method for positioning an embroidery hoop having improvements over current devices, systems and methods since it allows for greater adjustability and flexibility in its operation.

It is another objective of the present invention to provide a framing table which includes a top surface having a plurality of grooves therein for slidably and selectively positioning an embroidery hoop attachment at multiple locations.

It is still another objective of the present invention to provide an embroidery hoop attachment and method of use which allows the attachment to be quickly, manually, releasably affixed in an infinite variety of positions on the surface of the framing table.

It is yet another objective of the present invention to provide an embroidery hoop attachment which includes a tensioning device to securely maintain an outer keyed embroidery hoop.

It is yet another objective of the present invention to provide a framing table having an upper surface with a plurality of vertical and horizontal indicia which will aid the operator in correctly positioning an embroidery hoop.

It is still another objective of the present invention to provide a device for positioning an embroidery hoop which includes a side hoop attachment contiguous to the framing table top for large, jacket hoops.

Various other advantages and objectives of the present invention will be realized by those skilled in the art as a more detailed explanation of the invention is presented below.

SUMMARY OF THE INVENTION

The aforementioned and other objectives can be realized by providing a method and device which includes an embroidery work or framing table having an upper surface containing one or more grooves therein. A groove follower is slidably positioned within the groove and a hoop receiver is rotatably affixed to the groove follower for positioning on the upper surface of the framing table. A handle is pivotally joined to the groove follower which can be rotated from an opened to a closed position. When the handle is down or closed, the groove follower exerts upward pressure against the walls of the groove to thereby prevent the hoop receiver from moving. When the handle is lifted or opened, then the groove follower descends and pressure is removed from the groove walls which allows the hoop receiver to be slidably moved along the framing surface of the table to a different position where the handle can then be closed and framing commenced thereat.

DESCRIPTION OF THE PREFERRED EMBODIMENTS

The preferred form of the invention includes a framing table having a wooden table top with an upper framing surface having a groove with a substantially triangular-shaped cross section with the side walls of the groove preferably at a angle greater than fourteen degrees (14°) measured from a vertical axis for ease in locking and unlocking a groove follower in position. A means to attach a hoop which includes the groove follower and a hoop receiver having a cam locking handle allows the operator to position a keyed hoop thereon at any desired location on the framing surface and to secure the hoop in place. The means for attaching the hoop can be positioned at any desired location on the framing surface and can be moved as often as required for different garments or for different framing positions on the same garment. The preferred surface of the framing table top includes a plurality of grooves and a plurality of parallel vertical and parallel horizontal indicia which aids and assists the operator in quickly positioning the hoop at the proper location.

The preferred method of the invention allows for adjustably positioning an embroidery hoop on a framing table and includes the steps of sliding the means for hoop attachment to a desired location on the top surface of the framing table, rotating the hoop receiver of the attachment on the table surface to a desired position and thereafter securing the hoop receiver in position by closing the handle which locks the groove follower against the upper wall surfaces of the groove. Thereafter the handle can be opened and the hoop receiver can be moved to a different position as needed.

DETAILED DESCRIPTION OF THE DRAWINGS AND OPERATION OF THE INVENTION

Figure 1:
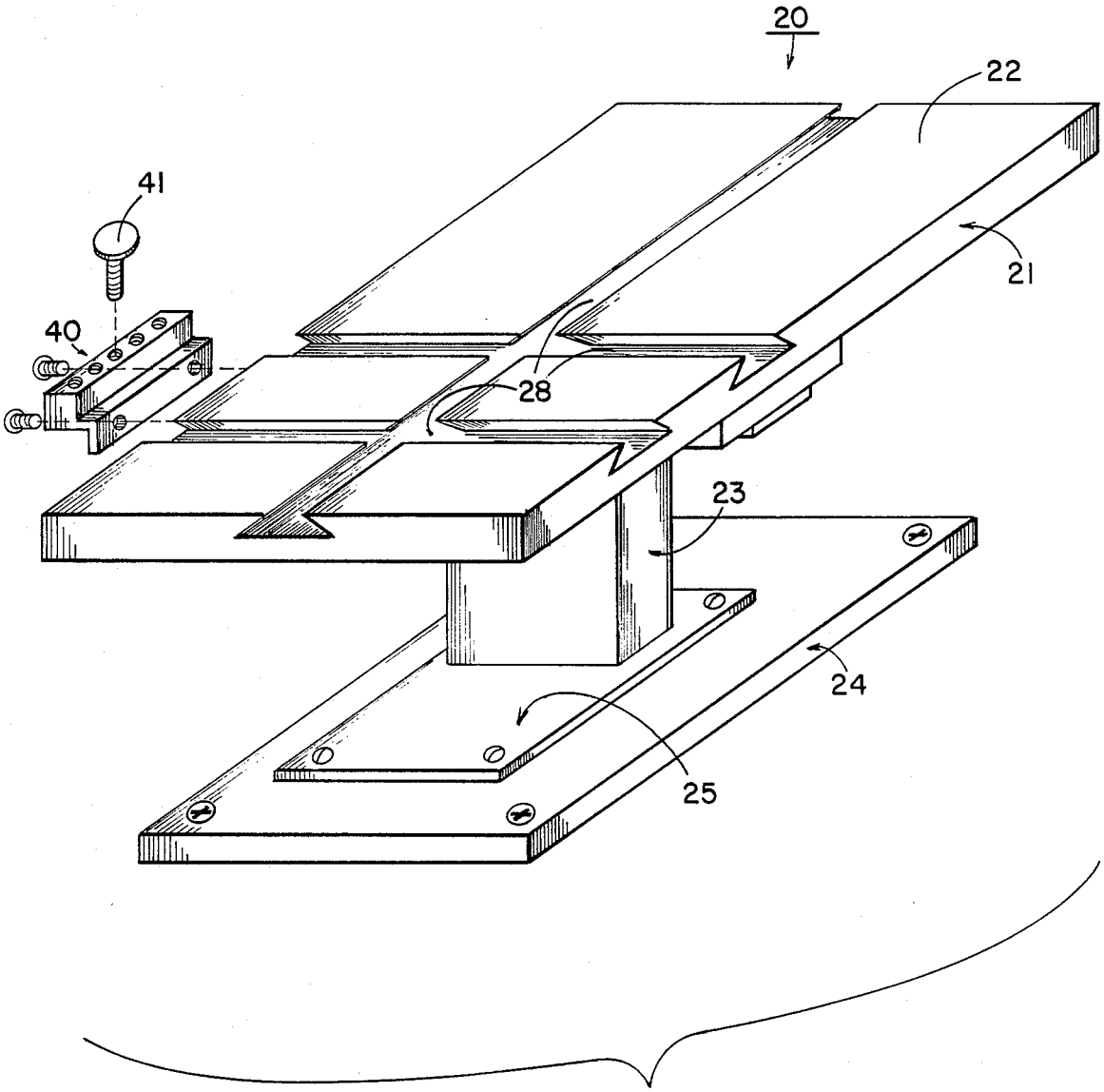
FIG. 1 shows in top front perspective fashion the framing table of the invention.

Turning now to the drawings, embroidery framing table 20 is shown in FIG. 1 in assembled form having a framing table top 21 with an upper framing surface 22 defining a plurality of grooves or hoop attachment means receivers 28 therein. As shown, hoop attachment means receivers 28 have a substantially triangular-shaped cross section for containing groove follower 72 as more easily seen in FIGS. 3 and 4.

Figure 2:
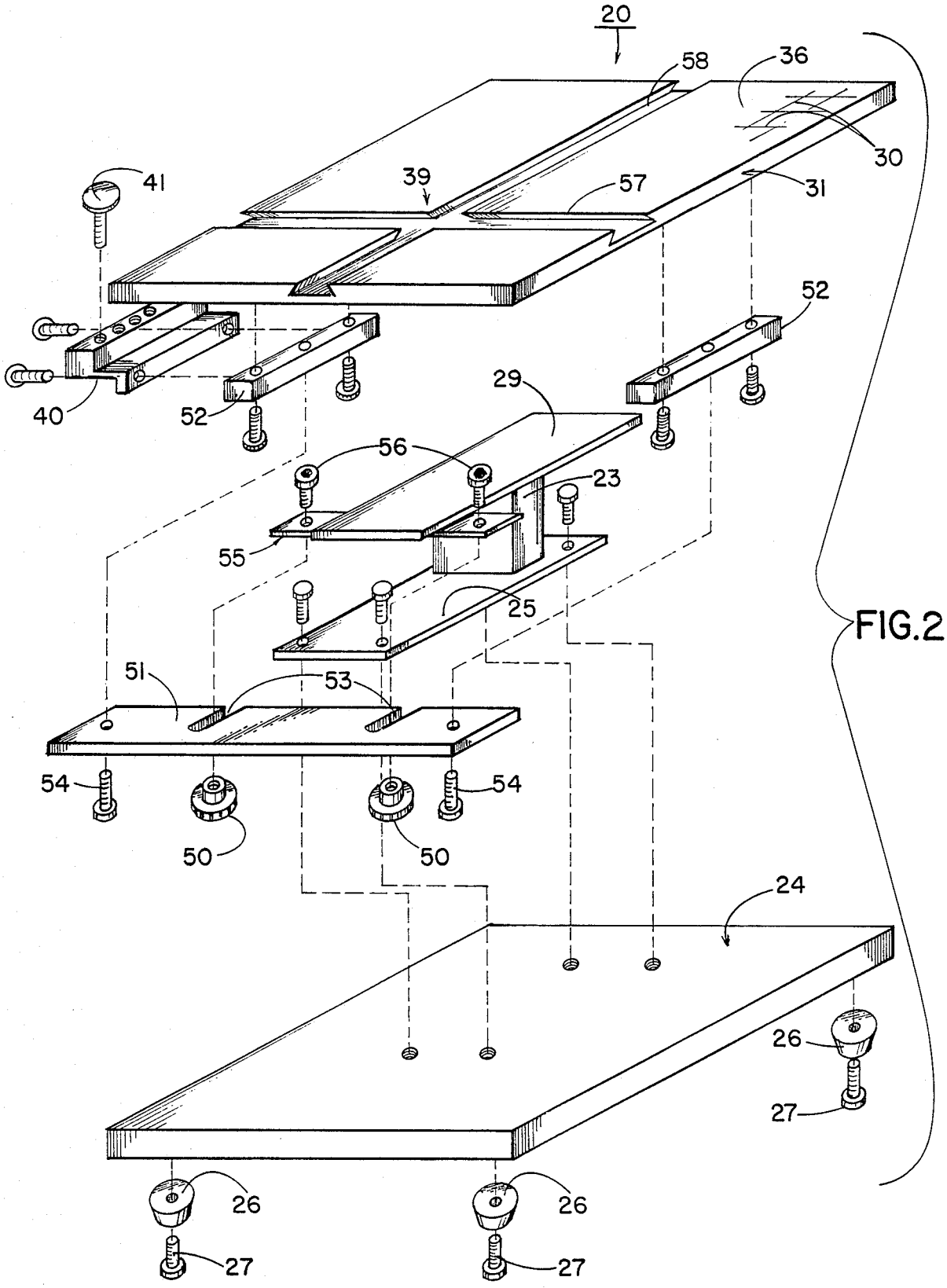
FIG. 2 demonstrates the framing table of FIG. 1 having a different table top and in an exploded manner to better illustrate the construction thereof.

Framing table 20 is seen in FIG. 2 in detailed exploded form with framing table top 31 having a t-shaped receiver 39 formed from perpendicular grooves 57 and 58. As further shown in FIG. 2, table base 24 has a base foot 26 which may be formed from rubber and is attached by foot securing means 27 at each corner of base 24 to prevent framing table 20 from moving during the cloth framing operation. Joined to table base 24 is stanchion base 25 which is affixed to stanchion 23. Stanchion 23 is mounted to stanchion plate 29, and as would be understood, framing table top 31 is slidably removed from stanchion plate 29 by loosening slide knobs 50 which tighten on slide studs 56. Table slide bracket 51 is rigidly affixed to slide mounting brackets 52 which are positioned underneath table top 31. Thus, table top 31 can be easily removed from stanchion plate 29 and a different table top such as top 21 shown in FIG. 1 can be mounted thereon with convenience and speed. Also shown in FIGS. 1 and 2 is side hoop attachment means 40 which is secured to slide mounting brackets 52 for use as will be explained in more detail hereinafter.

Figure 3:
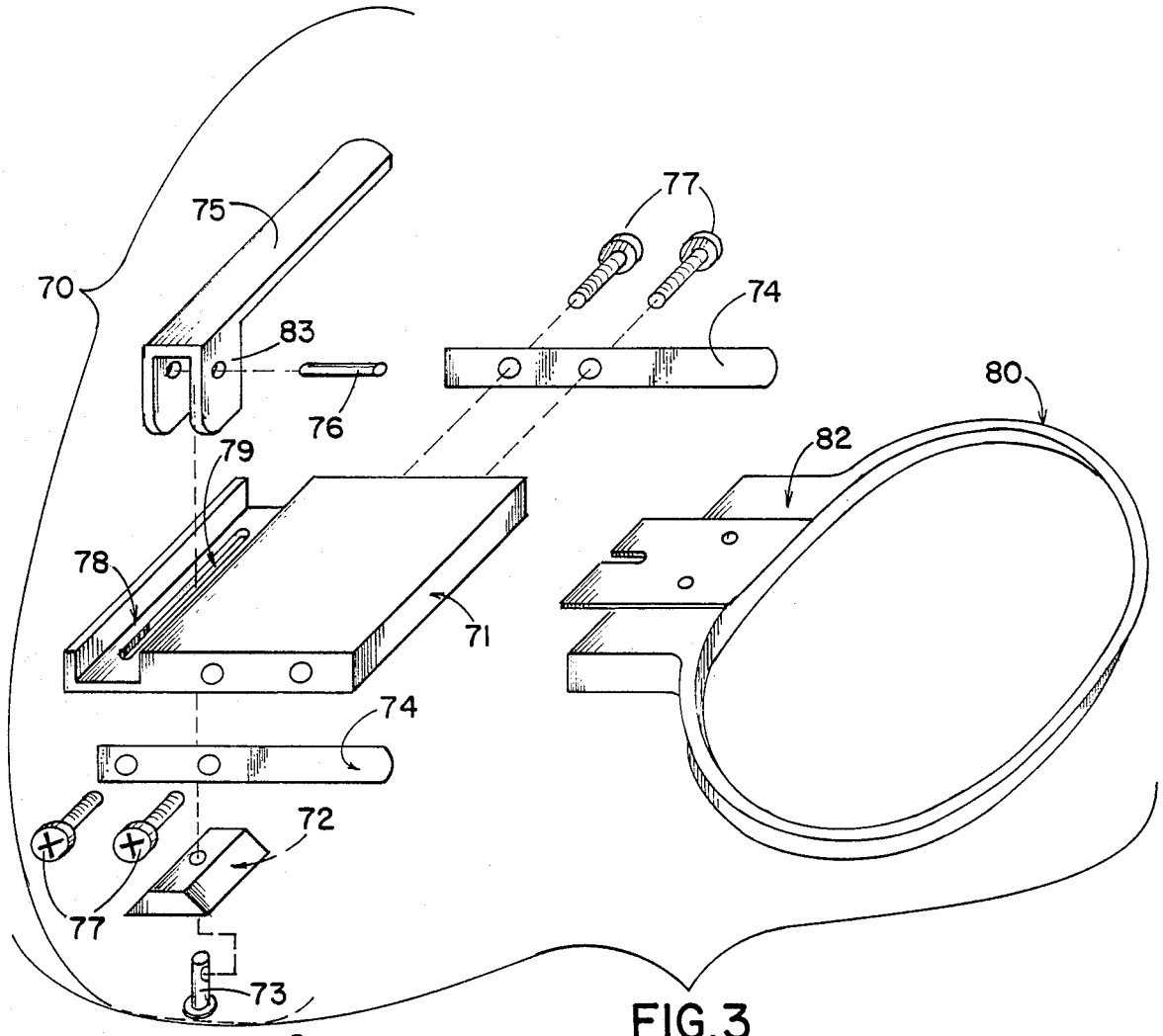
FIG. 3 illustrates in disassembled form means for attaching a keyed outer embroidery hoop to the framing table.

Hoop attachment means 70 as shown in FIG. 3 depicts groove follower 72 joined to hoop receiver 71 by groove follower stud 73 when assembled. Groove follower stud 73 extends through hoop receiver slot 79 into handle groove 78. Cam locking handle 75 is pivotally mounted to groove follower stud 73 by handle pin 76. On each side of hoop receiver 71 is positioned tensioning means 74 which comprises a spring steel member having flared tips for resiliently engaging hoop base 82 of outer hoop 80 as also seen in FIG. 3. Tensioning means screws 77 affix tensioning means 74 to hoop receiver 71.

Figure 4:
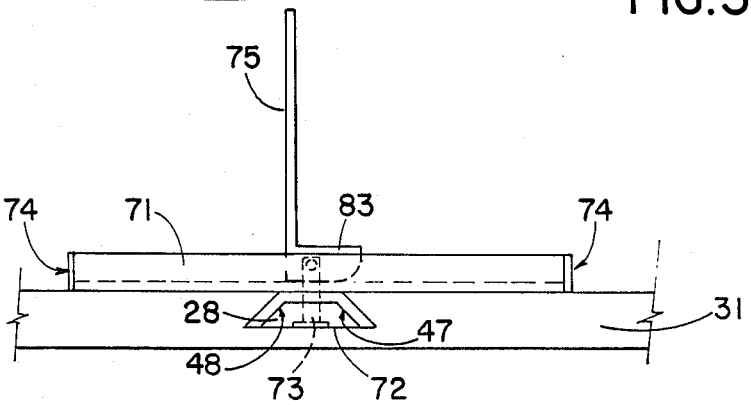
FIG. 4 depicts the apparatus of FIG. 3 in place on the framing table top in an open or movable posture.
Figure 5:
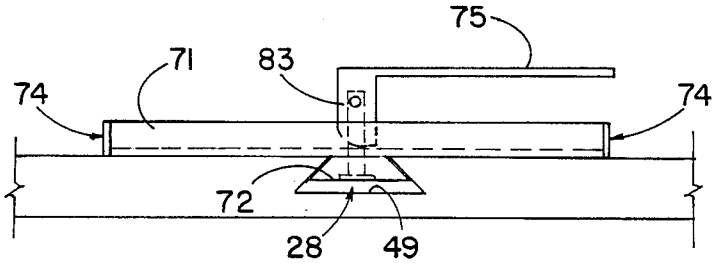
FIG. 5 demonstrates the device as shown in FIG. 4 except with the handle in the closed position.

The operation of handle 75 is best shown in FIGS. 4 and 5 in which handle cam 83 lifts groove follower stud 73 causing groove follower 72 to press against the upper walls 47, 48 of hoop attachment means receiver 28 as shown in FIG. 5. In FIG. 4, handle 75 is upright or "opened" with groove follower 72 positioned against the lower or bottom surface 49 of hoop attachment means receiver 28. In FIG. 5, handle 75 is in the down or "closed" position with groove follower 72 pressing tightly against the upper walls 47, 48 of hoop attachment means receiver 28 thereby locking hoop attachment means 70 in place. As would be understood from FIG. 3, hoop attachment means 70 is pivotable and hoop receiver 71 can rotate three hundred sixty degrees (360°) around groove follower stud 73 with handle 75 in the open position as shown in FIG. 4.

Figure 9:
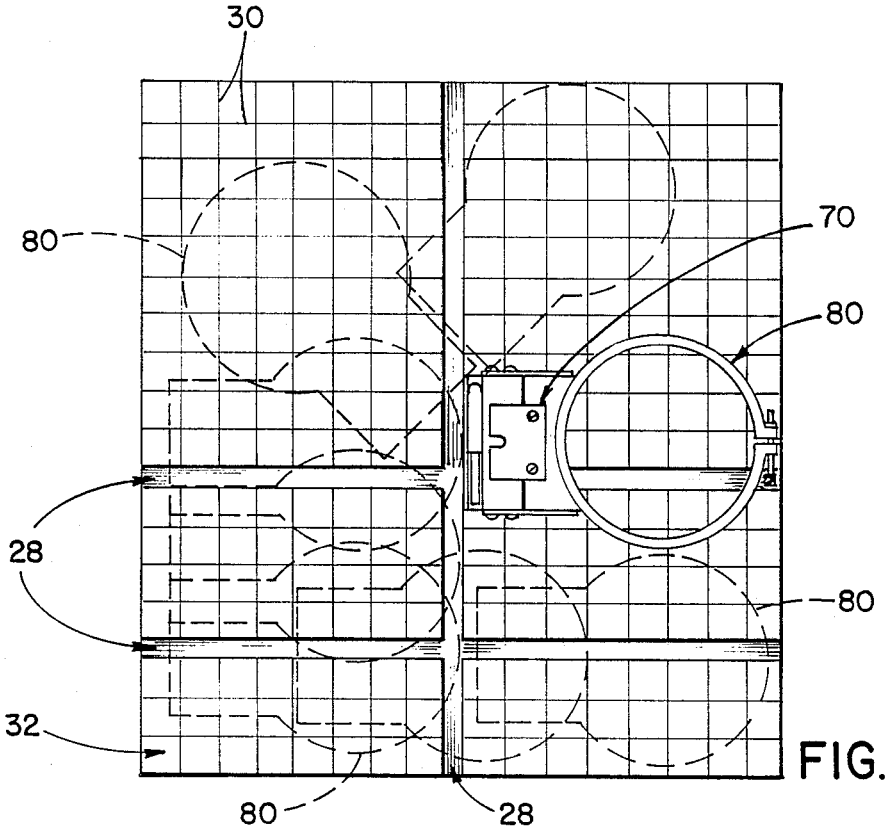
FIG. 9 demonstrates a table top with a small outer keyed embroidery hoop and with dotted lines a multiplicity of hoop positions are shown.
Figure 8:
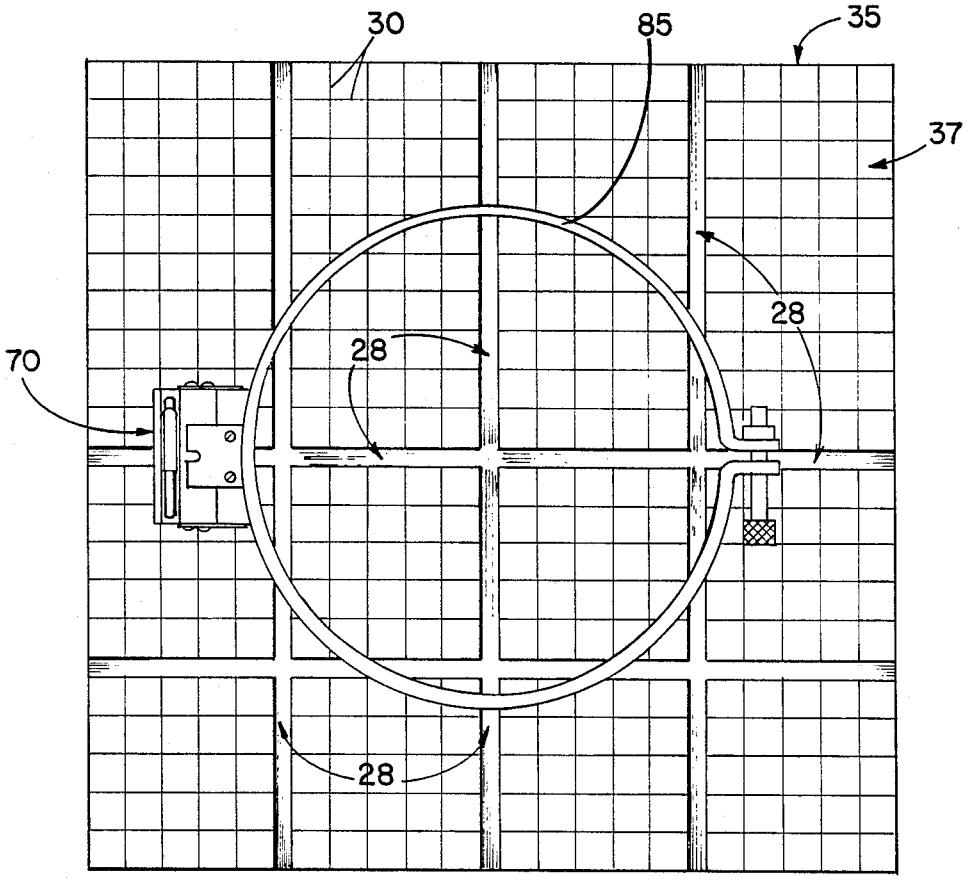
FIG. 8 illustrates another embodiment of a framing table top with a large outer keyed embroidery hoop affixed thereto.

In order to better understand the versatility and advantages of hoop attachment means 70, as shown in FIG. 8 a relatively large keyed outer embroidery hoop 85 is shown affixed to hoop attachment means 70 positioned proximate the center of framing table top 35. Indicating means or indicia 30 allows for convenient selective alignment of hoop 81 in any desired position. In FIG. 9 a smaller keyed embroidery framing hoop 80 is affixed to hoop attachment means 70 at one location and dotted line configurations demonstrate a few of the various other locations in an infinite variety which are available. Indicia 30 as shown therein may be marked lines on the surface of table top 32 or may be shallow grooves to help the operator properly position hoop 80 thereon and to insure uniformity in framing which is a critical step in the embroidering process. Hoop attachment means 70 is moved from location to location by the operator lifting handle 75, sliding hoop receiver 71 to a different location and thereafter locking it in place by closing handle 75.

Figure 6:
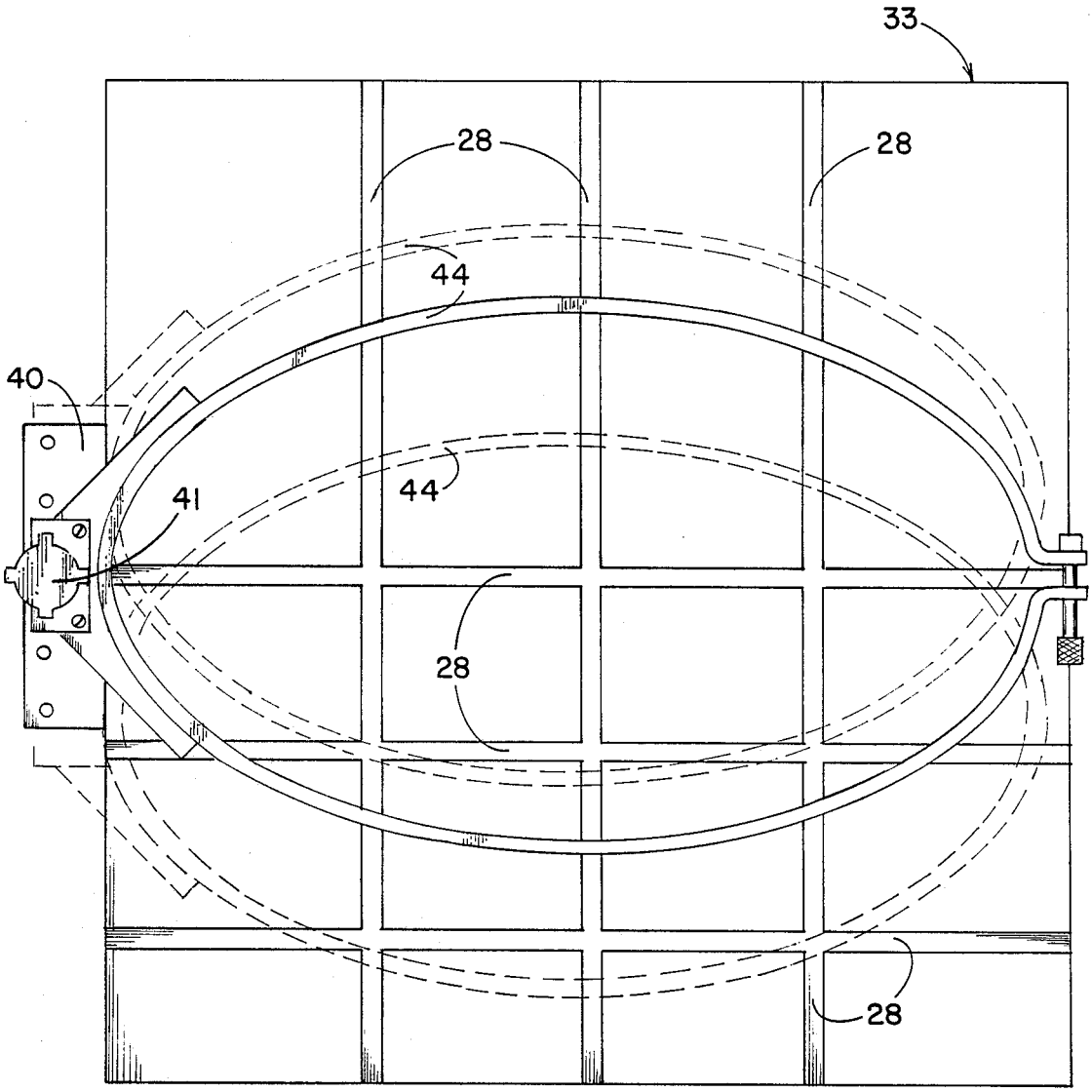
FIG. 6 shows a framing table top with a side hoop attachment thereon.
Figure 7:
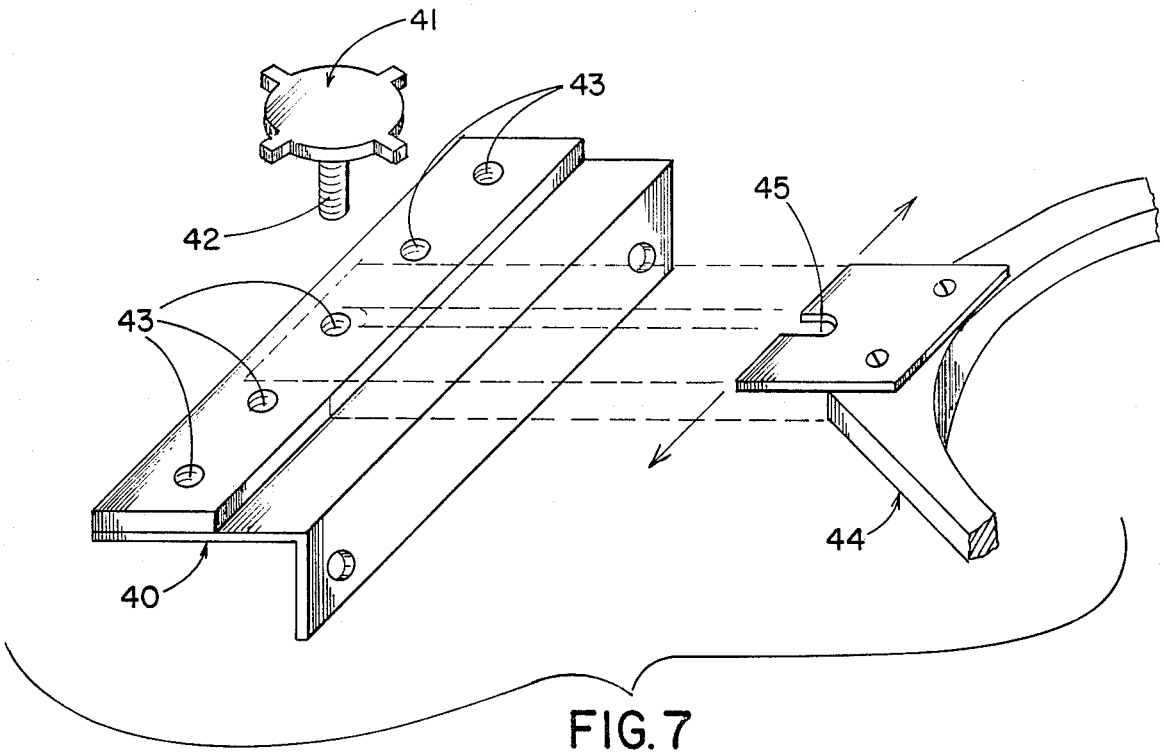
FIG. 7 demonstrates an enlarged view of the side hoop attachment.

Side hoop attachment means 40 as shown in FIGS. 6 and 7 allows for the correct and variable placement of a large keyed hoop normally referred to as a "jacket" hoop as shown at 44 in FIG. 6. Jacket hoop 44 is used for embroidering a name or the like across an actual jacket back such as bowling jackets, company casual jackets or the like. As shown in FIG. 7, side hoop attachment means 40 includes locking knob 41 which slides through jacket hoop aperture 45 where it is threadably received in one of the threaded shaft receiving apertures 43. Locking knob 41 which is affixed to threaded knob shaft 42 can be positioned in any one of the five (5)- apertures 43 communicate with the top surface of side hoop attachment means 40 as shown in FIG. 6. Side attachment means 40 is permanently affixed to table top slide mounting brackets 52 as better shown in FIGS. 1 and 2.

Figure 13:
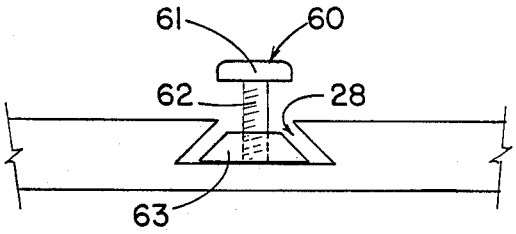
FIG. 13 demonstrates a button simulator in the slidable mode positioned within the groove of the upper surface of a framing table.
Figure 14:
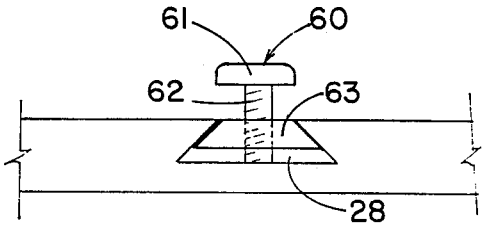
FIG. 14 demonstrates the button simulator as shown in FIG. 13 in the fixed mode.
Figure 10:
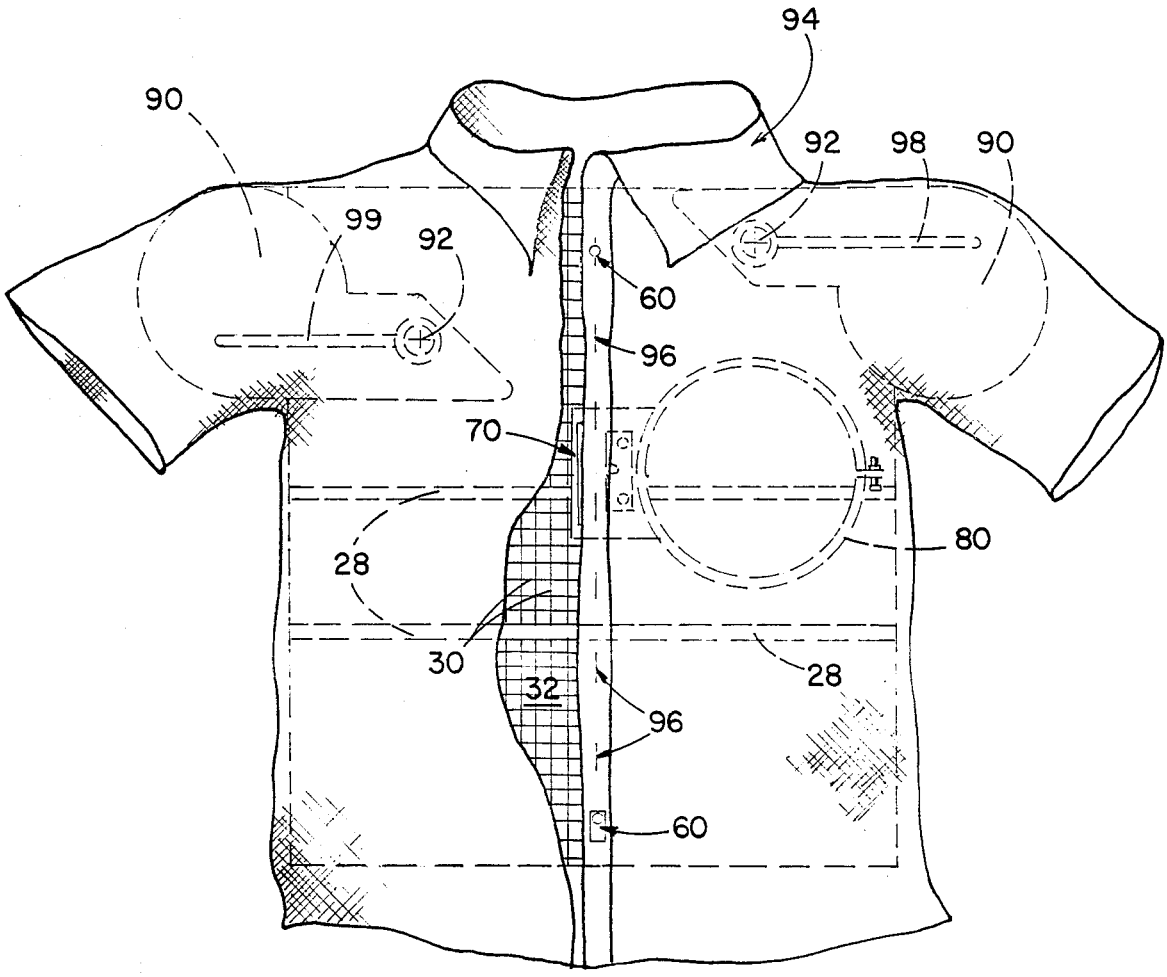
FIG. 10 depicts a conventional sports shirt positioned on the framing table top for left front pocket framing and subsequent embroidering.
Figure 11:
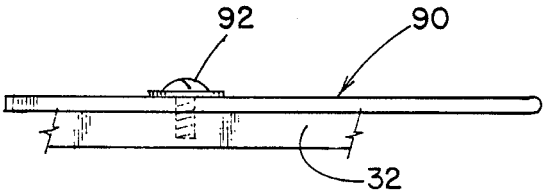
FIG. 11 shows in a side elevational view of the right stub as seen in FIG. 10.
Figure 12:
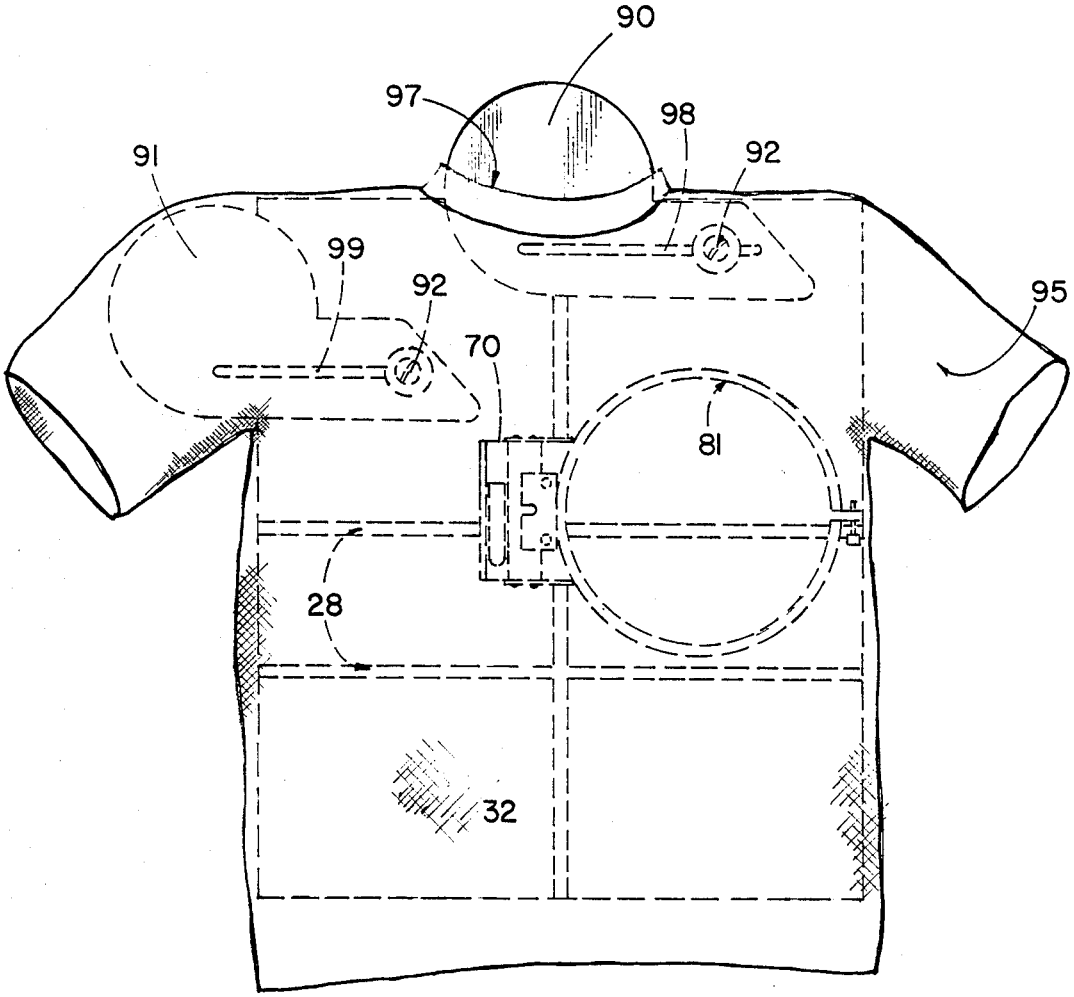
FIG. 12 illustrates the table top as shown in FIG. 10 but with the right stub positioned at the neck of a garment with a large embroidery hoop on the left front pocket area.

In order to assist the operator in placing a garment such as a conventional collared shirt 94 or t-shirt 95 on table top 32 as shown in FIGS. 10 and 12, right stub member 90 and left stub member 91 are utilized. In FIG. 10, stud members 90 and 91 are used in the shoulder and arm areas of sport shirt 94. To insure correct alignment, button holes 96 can be positioned over button simulators 60 as shown in FIGS. 13 and 14. Button simulator 60 includes button cap 61 which is urged through button hole 96 and button simulator 60 can be slid along hoop attachment means receiver 28 and as seen in FIGS. 13 and 14, upon rotating simulator 60, threaded stud 62 moves downwardly through simulator groove follower 63 which includes a threaded opening whereby simulator groove follower 63 moves upwardly within 28 to wedge against the upper walls 47, 48 as shown in FIG. 14. Button simulator groove follower 63 has a substantially triangular-shaped cross section to fit within hoop attachment means receiver 28 and to be tightenable therein. Button simulator 60 is not used or necessary when monogramming conventional t-shirts 95 as seen in FIG. 12. Right stub member 90 is shown in FIG. 12 located approximately one hundred eighty degrees (180°) from its posture as seen in FIG. 10 to accommodate neck 97 of t-shirt 95. Right stub member 90 and left stub member 91 can be adjustably positioned along framing table top 32 as shown in FIGS. 10 and 11 by loosening stub bolt 92 and sliding stub members 91 and 92 along, for example, right stub slot 98 of right stub member 90 or left stub slot 99 of left stub member 91 as required.

The apparatus and methods as described herein can be modified by those skilled in the art and the examples and illustrations are for explanatory purposes and are not intended to limit the scope of the appended claims.

I claim:

1. A device for positioning an embroidery hoop for framing cloth comprising: a framing surface on an embroidery machine hoop attachment means, said hoop attachment means adjustably movable along said framing surface for positioning a hoop at a desired location therealong and including a button simulator for positioning a button hole on the cloth relative to the framing surface, said simulator movably affixed to said framing surface.

2. A device for positioning an embroidery hoop for framing cloth comprising: a framing surface on an embroidery machine, hoop attachment means, said hoop attachment means adjustably movable along said framing surface for positioning a hoop at a desired location therealong and including a stub member for positioning the cloth relative to the framing surface, said stub member rotatably attached to said framing surface so as to be rotatable along the horizontal plane of the framing surface.

3. A device for selectively positioning an embroidery hoop for framing of a shirt or the like for subsequent embroidering thereon comprising: a framing table on an embroidery machine, said framing table having a table top with a substantially flat upper surface, said surface defining a hoop attachment means receiver, said hoop attachment means receiver consisting of a groove, said groove having a substantially triangular-shaped cross section, hoop attachment means, said hoop attachment means including: (i) a groove follower, (ii) a hoop receiver and (iii) a handle, said handle pivotally attached to said groove follower to secure said hoop attachment means at a desired location, said groove follower slidably positioned in said hoop attachment means receiver, a follower stud, said stud joined to said groove follower, said hoop receiver having a stud slot, said stud movably positionable along said slot, hoop receiver tensioning means, said hoop receiver tensioning means affixed to said hoop receiver whereby said hoop receiver is adjustably positionable on said framing table top upper surface at a desired location and is releasably securable by said handle for receiving an embroidery hoop for framing purposes.

4. A device as claimed in claim 3 and including indicating means, said indicating means positioned on said framing table top upper surface.

5. A device as claimed in claim 16 wherein said upper surface includes indicating means.

6. A device as claimed in claim 16 wherein said upper surface defines a plurality of hoop attachment means receivers.

7. A device as claimed in claim 16 wherein said hoop receiver includes a hoop receiver tensioning means.

* * * * *